US008833883B2

(12) United States Patent
Oomura

(10) Patent No.: US 8,833,883 B2
(45) Date of Patent: Sep. 16, 2014

(54) LIQUID DISCHARGE HEAD AND LIQUID DISCHARGE APPARATUS

(75) Inventor: Masanobu Oomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 13/422,545

(22) Filed: Mar. 16, 2012

(65) Prior Publication Data

US 2012/0249635 A1 Oct. 4, 2012

(30) Foreign Application Priority Data

Mar. 31, 2011 (JP) ..... 2011-079803

(51) Int. Cl.
*B41J 29/38* (2006.01)
*B41J 2/045* (2006.01)
*B41J 2/14* (2006.01)

(52) U.S. Cl.
CPC ..... *B41J 2/14072* (2013.01); *B41J 2/0455* (2013.01); *B41J 2/0458* (2013.01); *B41J 2/04541* (2013.01)
USPC ..... 347/5; 347/9

(58) Field of Classification Search
CPC .... B41J 2/0452; B41J 2/04548; B41J 2/0455; B41J 2/04555; B41J 2/0457; B41J 2/0458
USPC ..... 347/5, 9, 10, 57, 58, 59
See application file for complete search history.

(56) References Cited

U.S. PATENT DOCUMENTS 6,471,324 B1 10/2002 Maru
7,125,105 B2 10/2006 Oomura
7,300,124 B2 11/2007 Oomura et al.
7,350,891 B2 4/2008 Oomura et al.
2009/0002457 A1 1/2009 Sakurai

FOREIGN PATENT DOCUMENTS

CN 201685526 U 12/2010
JP 2000-141660 A 5/2000
JP 2005-169868 A 6/2005

OTHER PUBLICATIONS

Communication dated Jul. 19, 2012, forwarding a European Search Report dated Jul. 10, 2012, in European Application No. 12160473.0-1251.
Office Action in Chinese Patent Application No. 201210092870.7, dated Mar. 28, 2014.

*Primary Examiner* — Julian Huffman
(74) *Attorney, Agent, or Firm* — Fitzpatrick, Cella, Harper & Scinto

(57) ABSTRACT

A liquid discharge head includes a signal processing circuit which operates with a first voltage, and generates a discharge control signal, a liquid driving circuit including an electrothermal transducer, a driving element which drives the electrothermal transducer, and a control circuit which receives the discharge control signal and outputs, to the driving element, a driving signal having a second voltage higher than the first voltage, and a monitoring circuit which monitors the first voltage and outputs a stop signal upon a drop of the first voltage. The control circuit stops driving the electrothermal transducer by the driving element in accordance with the stop signal. The monitoring circuit includes a transistor including a drain connected to power supply voltage node through a step-down circuit, a source connected to ground side, and a gate receiving the first voltage.

10 Claims, 3 Drawing Sheets

LIQUID DISCHARGE HEAD AND LIQUID DISCHARGE APPARATUS

BACKGROUND OF THE INVENTION

1. Field of the Invention

The present invention relates to a liquid discharge head and liquid discharge apparatus.

2. Description of the Related Art

Japanese Patent Laid-Open No. 2000-141660 discloses a printhead which receives a control signal and print data via a plurality of electric contacts. This printhead includes the first contact which receives a voltage for driving a printing element, a control circuit for controlling driving of the printing element, and the second contract which receives a voltage for driving the control circuit. This printhead also includes a monitoring circuit (VDD monitoring circuit) which monitors a voltage at the second contract, and a protection circuit which stops driving of the printing element by the control circuit when the monitoring circuit detects that the voltage at the second contact has dropped. The monitoring circuit (VDD monitoring circuit) includes a first-stage inverter having an input terminal connected to the second contact (pad) connected to the VDD power supply, a plurality of inverters which are connected to the subsequent stage of the first-stage inverter, and a pull-down resistor which is connected between the second contact and ground. These inverters receive a power supply voltage VH (VH>VDD) equal to the heater driving voltage. When supply of VDD power from a printing apparatus equipped with a printhead to the printhead is cut off due to some cause, the monitoring circuit detects a voltage drop at the second contact that is caused by the cutoff, and the protection circuit operates.

Japanese Patent Laid-Open No. 2000-141660 does not describe the detailed arrangement of the inverters in the monitoring circuit. If the inverter is formed from a general CMOS (PMOS and NMOS transistors), the VDD power voltage is 3 V, and the heater driving voltage VH is 24 V, a voltage of about 21 V is applied between the gate and source of the PMOS transistor. In this state, the output logic of the first-stage inverter becomes indefinite or a large flow through current flows. To solve this problem, a PMOS transistor with a very high threshold voltage is prepared, or the gate length of the PMOS transistor is greatly increased. However, these measures newly arouse other concerns. That is, preparing a PMOS transistor with a very high threshold voltage needs to use a special semiconductor manufacturing process different from the manufacturing process of a general PMOS transistor, raising the cost. Also, a very large gate length of the PMOS transistor results in a large chip size.

SUMMARY OF THE INVENTION

The present invention provides a liquid discharge head having a simple arrangement advantageous to cost reduction.

The first aspect of the present invention provides a liquid discharge head which discharges a liquid, comprising: a signal processing circuit which operates with a first voltage, and generates a discharge control signal for controlling discharge of a liquid; a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit is configured to stop driving the electrothermal transducer by the driving element in accordance with the stop signal, the monitoring circuit includes a transistor which includes a drain connected to a side of a power supply voltage node, a source connected to a side of ground, and a gate receiving the first voltage, and a step-down circuit which is interposed between the power supply voltage node and the drain and decreases a voltage applied between the source and the drain, and the stop signal is output from the drain or a node at which a voltage changes depending on a voltage at the drain.

The second aspect of the present invention provides a liquid discharge apparatus comprising a liquid discharge head defined as the first aspect of the present invention.

Further features of the present invention will become apparent from the following description of exemplary embodiments with reference to the attached drawings.

DESCRIPTION OF THE EMBODIMENTS

A liquid discharge head according to the present invention can be implemented as a head which records an image on a medium or member such as paper, or a head which applies a liquid to an object such as a substrate to manufacture a device such as a DNA chip, organic transistor, or color filter. A liquid discharge apparatus according to the present invention includes the liquid discharge head and a major portion on which the liquid discharge head is mounted. The major portion can include a driving mechanism of moving the liquid discharge head. The following embodiment will explain an example in which ink is used as a liquid to be discharged.

Figure 1:
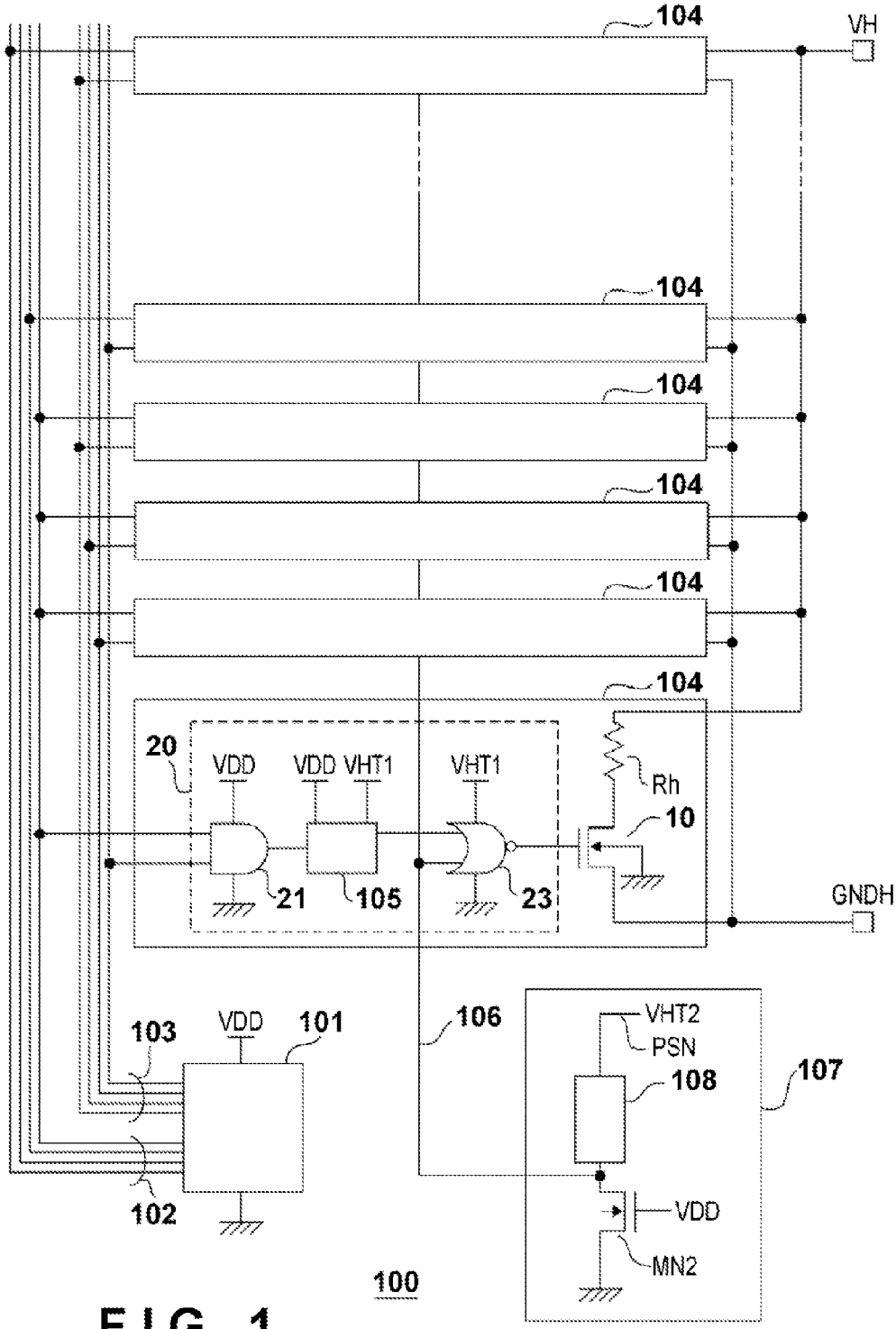
FIG. 1 is a circuit diagram showing the arrangement of an ink discharge head according to the first embodiment.

An ink discharge head (liquid discharge head) 100 according to the first embodiment of the present invention will be described with reference to FIG. 1. FIG. 1 illustrates neither an ink nozzle which discharges ink heated by an electrothermal transducer Rh, nor an ink supply portion which supplies ink to the ink nozzle. The ink discharge head 100 includes a signal processing circuit 101, a plurality of ink driving circuits (liquid driving circuits) 104 which are arrayed, and a monitoring circuit 107. One ink driving circuit 104 corresponds to one ink nozzle.

Upon receiving a first voltage VDD as the power supply voltage, the signal processing circuit 101 generates, based on an image signal sent from the major portion, a discharge control signal for controlling ink discharge. The ink discharge control signal is a signal representing whether to discharge ink. Each ink driving circuit 104 includes, for example, the electrothermal transducer (for example, resistance element) Rh, a driving element 10, and a control circuit 20. The driving element 10 and electrothermal transducer Rh are series-connected between a discharge voltage VH and discharge ground GNDH. Upon receiving the discharge control signal from the signal processing circuit 101, the control circuit 20 outputs, to the driving element 10, a driving signal having a second voltage VHT1 higher than the first voltage VDD. The driving element 10 can include, for example, a MOS transistor such as a DMOS (Diffused MOS) transistor. The DMOS transistor features a small ON resistance value.

The monitoring circuit 107 monitors the first voltage VDD, and outputs a stop signal to a stop signal line 106 upon a drop of the first voltage VDD. The control circuit 20 of each ink driving circuit 104 is configured to stop driving the electrothermal transducer Rh by the driving element 10 in accordance with the stop signal. The monitoring circuit 107 includes a transistor (NMOS transistor) MN2 and step-down circuit 108. The transistor MN2 has a drain connected to a side of a power supply voltage node PSN which receives a third voltage VHT2 higher than the first voltage VDD, and a source connected to a side of ground. The transistor MN2 receives the first voltage VDD at the gate. The step-down circuit 108 is interposed between the power supply voltage node PSN and the drain of the transistor MN2, and decreases a voltage applied between the source and drain of the transistor MN2. In this embodiment, the stop signal is output from the drain of the transistor MN2 to the stop signal line 106. The second voltage VHT1 and third voltage VHT2 may be equal to or different from each other.

The threshold voltage of the transistor MN2 is lower than the first power supply voltage VDD. The transistor MN2 has a characteristic in which the impedance (resistance value) of the transistor MN2 upon applying a voltage of a predetermined level or higher to the gate becomes much smaller than that of the step-down circuit 108. The monitoring circuit 107 can be arranged outside the region where a plurality of ink driving circuits 104 are arrayed.

The signal processing circuit 101 processes, for example, an image signal sent from the major portion of the ink discharge apparatus, generating a block selecting signal formed from a plurality of bits, and a discharge control signal formed from a plurality of bits. The signal processing circuit 101 outputs the block selecting signal and discharge control signal to block selecting signal lines 102 and discharge control signal lines 103, respectively. The block selecting signal and discharge control signal have the first voltage VDD as the logical high level. A plurality of ink driving circuits 104 are divided into a plurality of groups. The block selecting signal output to the block selecting signal lines 102 represents a group to be selected from the ink driving circuits 104. As described above, the discharge control signal output to the discharge control signal lines 103 is a signal generated in accordance with an image to be formed, and represents whether to discharge ink. When both the block selecting signal and discharge control signal input to the ink driving circuit 104 are at an active level, the control circuit 20 of the ink driving circuit 104 operates (turns on) the driving element 10 of the ink driving circuit 104. Hence, the electrothermal transducer Rh of the ink driving circuit 104 is driven, discharging ink by heat generated by the electrothermal transducer Rh.

The control circuit 20 of the ink driving circuit 104 can include an AND circuit 21, level converter 105, and NOR circuit 23. Upon receiving supply of the first voltage VDD as the power supply voltage, the AND circuit 21 operates to calculate the AND of the block selecting signal and discharge control signal respectively output to the block selecting signal lines 102 and discharge control signal lines 103, and then outputs the AND. The operation of the AND circuit 21 can be regarded as an operation of transferring the input discharge control signal to the output side when the input block selecting signal is at an active level.

Upon receiving supply of the first voltage VDD and second voltage VHT1 as the power supply voltage, the level converter 105 operate to output, to the driving element 10, a driving signal (signal corresponding to the discharge control signal) having the second voltage VHT1 as the logical high level. The NOR circuit 23 operates upon receiving supply of the second voltage VHT1 as the power supply voltage. The NOR circuit 23 includes the first input terminal for receiving the driving signal output from the level converter 105, the second input terminal for receiving the stop signal output from the monitoring circuit 107, and an output terminal connected to the driving element 10. The NOR circuit 23 calculates the negative OR of the driving signal and stop signal, and outputs it to the driving element 10.

Figure 3A:
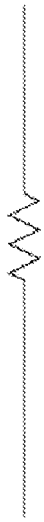
FIGS. 3A to 3C are circuit diagrams showing examples of a step-down circuit.
Figure 3B:
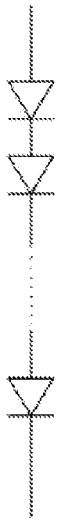
Figure 3C:
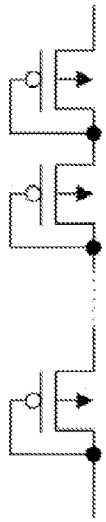

FIGS. 3A to 3C show examples of the arrangement of the step-down circuit 108. In the example shown in FIG. 3A, the step-down circuit 108 includes a resistance element. To reduce current consumption in the monitoring circuit 107 upon application of the first power supply voltage VDD, the resistance value of the resistance element should be increased. In the example shown in FIG. 3B, the step-down circuit 108 includes at least one diode. In the example shown in FIG. 3C, the step-down circuit 108 includes at least one diode-connected MOS transistor. The example shown in FIG. 3C adopts a PMOS transistor, but an NMOS transistor may replace the PMOS transistor. At least two of the three arrangement examples shown in FIGS. 3A to 3C may be combined. The step-down circuit 108 can be arranged to decrease a voltage applied between the gate and drain of the transistor MN2.

The first voltage VDD, second voltage VHT1, third voltage VHT2, and driving voltage VH will be explained. In one embodiment, the first voltage VDD is 3 to 5 V, the driving voltage VH is 24 V, and the second voltage VHT1 and third voltage VHT2 can be equal to each other. The second voltage VHT1 is applied to the gate of an NMOS transistor serving as the driving element 10. A higher voltage can reduce the ON resistance of the NMOS transistor. Thus, the second voltage VHT1 can be set equal to the driving voltage VH. However, when the second voltage VHT1 is set equal to the driving voltage VH, a high-voltage tolerant PMOS transistor is required as a PMOS transistor which forms the level converter 105, in order to ensure the drain-back gate voltage tolerance. This may raise the cost of the semiconductor manufacturing process. To prevent this, it is desirable to increase the second voltage VHT1 to be an intermediate voltage between the first voltage VDD and the driving voltage VH as long as the voltage tolerance of the PMOS transistor which forms the level converter 105 can be guaranteed. When the second voltage VHT1 and third voltage VHT2 are set to intermediate voltages between the first voltage VDD and the driving voltage VH, the major portion can supply the second voltage VHT1 and third voltage VHT2. Alternatively, a step-down circuit may be arranged in the ink discharge head 100 to decrease the driving voltage VH, thereby generating the second voltage VHT1 and third voltage VHT2.

Figure 2:
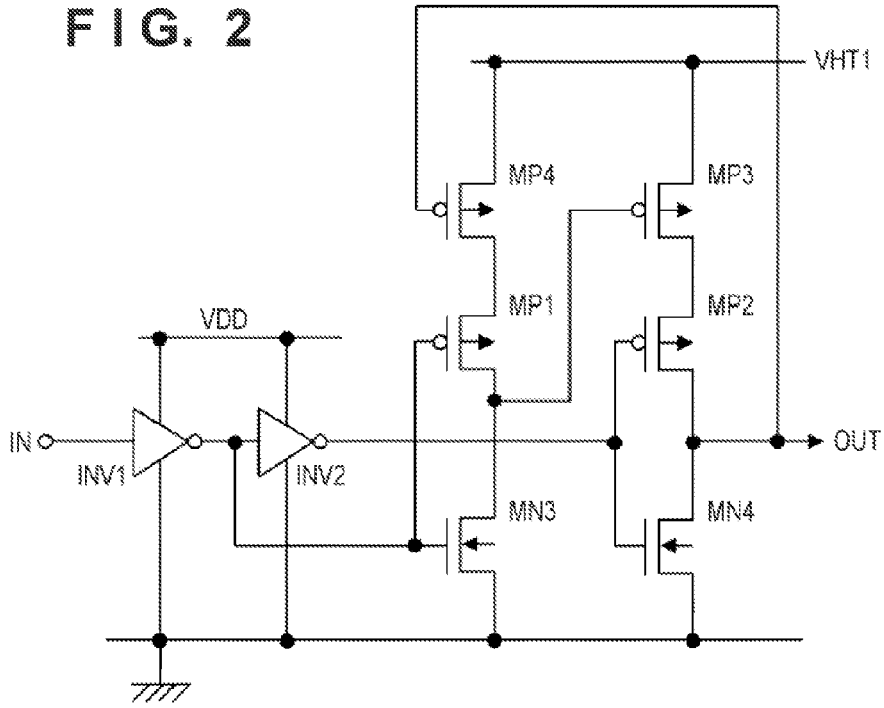
FIG. 2 is a circuit diagram exemplifying the arrangement of a level converter.

An example of the arrangement of the level converter 105 will be explained with reference to FIG. 2. The output terminal of the AND circuit 21 is connected to the input terminal of a first inverter circuit INV1 which operates upon receiving supply of the first voltage VDD as the power supply voltage. The output terminal of the first inverter circuit INV1 is connected to the gates of a second inverter circuit INV2 and NMOS transistor MN3 which operate upon receiving supply of the first voltage VDD as the power supply voltage, and the gate of a PMOS transistor MP1. The output terminal of the second inverter circuit INV2 is connected to the gates of an NMOS transistor MN4 and PMOS transistor MP2. The sources of the NMOS transistors MN3 and MN4 are grounded. The drain of the NMOS transistor MN3 is connected to the drain of the PMOS transistor MP1 and the gate of a PMOS transistor MP3. The drain of the NMOS transistor MN4 is connected to the drain of the PMOS transistor MP2 and the gate of a PMOS transistor MP4, and the connection point between them serves as the output node OUT of the level converter 105. With this arrangement, a signal having the voltage amplitude of the first voltage VDD can be converted into a signal having the voltage amplitude of the second voltage VHT1.

The signal processing circuit 101, ink driving circuits 104, and monitoring circuit 107 of the ink discharge head 100 can be formed as a semiconductor integrated circuit on a semiconductor substrate such as a silicon substrate. The semiconductor integrated circuit has a p-n junction. Thus, when supply of the first voltage VDD from the major portion is cut off, the first voltage VDD supply line (power supply voltage line) becomes almost the ground level. The output signals of the inverter circuits INV1 and INV2 connected to the first voltage VDD supply line in the level converter 105 become almost the ground level, turning off the NMOS transistors MN3 and MN4. However, while the second voltage VHT1 is applied without applying the first voltage VDD, voltages at the gates of the transistors MP3 and MP4 become indefinite, and a voltage at the output node OUT of the level converter 105 also becomes indefinite. In the monitoring circuit 107, when no first voltage VDD is applied, the voltage of the first voltage VDD supply line becomes almost the ground level, and the transistor MN2 is turned off. Hence, the stop signal on the stop signal line 106 changes to the logical high level, that is, almost the third voltage VHT2.

When the stop signal is at the logical high level, the output level of the NOR circuit 23 in the control circuit 20 of the ink driving circuit 104 becomes the logical low level (almost ground level) regardless of an output from the level converter 105. While no first voltage VDD is applied, the transistor MN2 of the monitoring circuit 107 maintains the OFF state. A current flowing through the electrothermal transducer Rh can therefore be cut off. While the first voltage VDD is applied properly, the transistor MN2 of the monitoring circuit 107 maintains the ON state. The stop signal on the stop signal line 106 becomes the logical low level, and does not affect a general operation.

As described above, according to the first embodiment, the step-down circuit 108 and transistor MN2 are series-connected between the third voltage VHT2 and ground. The first voltage VDD is applied to the gate of the transistor MN2, and the stop signal is output from the drain of the transistor MN2. By employing this arrangement, the arrangement of the monitoring circuit 107 can be simplified. This can contribute to cost reduction. Also, according to the first embodiment, the NOR circuit 23 is interposed between the level converter 105 of each ink driving circuit 104 and the driving element 10, and the stop signal is supplied to one input terminal of the NOR circuit 23. Even this simple arrangement can reliably stop the driving element 10 when the first voltage VDD is cut off.

Figure 4:
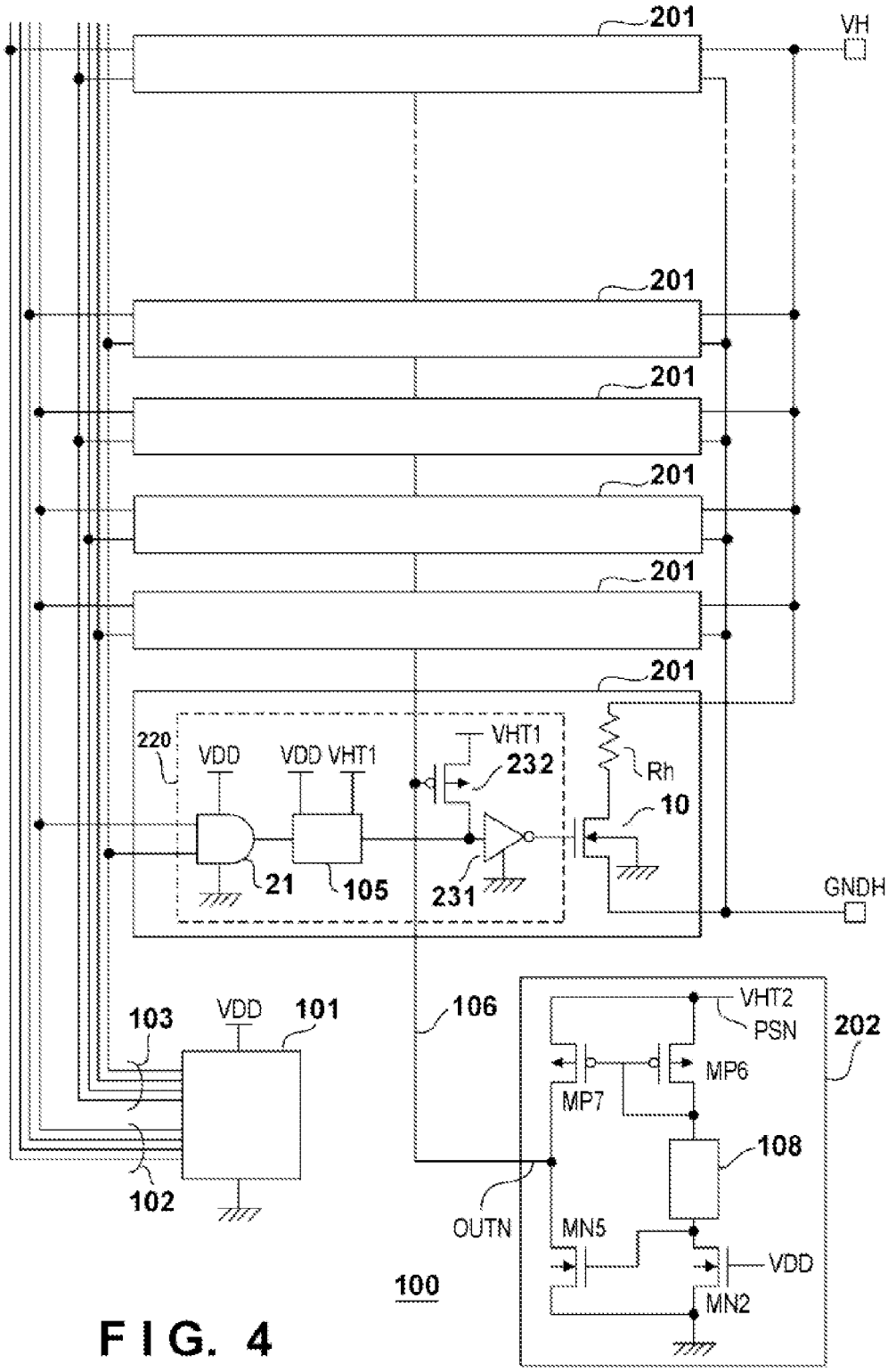
FIG. 4 is a circuit diagram showing the arrangement of an ink discharge head according to the second embodiment.

An ink discharge head 100 according to the second embodiment of the present invention will be described with reference to FIG. 4. The first embodiment can apply to matters which will not be mentioned in the second embodiment. In the second embodiment, an ink driving circuit 201 and monitoring circuit 202 replace the ink driving circuit 104 and monitoring circuit 107 of the first embodiment, respectively.

Each ink driving circuit 201 includes, for example, an electrothermal transducer (for example, resistance element) Rh, a driving element 10, and a control circuit 220. The driving element 10 is series-connected to the electrothermal transducer Rh between the discharge voltage VH and ground. Upon receiving a discharge control signal from a signal processing circuit 101, the control circuit 220 outputs, to the driving element 10, a driving signal having a second voltage VHT1 for which the logical high level is higher than the first voltage VDD. The control circuit 220 of each ink driving circuit 201 is configured to stop driving the electrothermal transducer Rh by the driving element 10 in response to a stop signal output from the monitoring circuit 202 to a stop signal line 106.

The control circuit 220 of the ink driving circuit 201 includes an AND circuit 21, level converter 105, inverter 231, and pull-up transistor 232. The AND circuit 21 and level converter 105 are the same as those in the first embodiment. The inverter 231 operates upon receiving supply of the second voltage VHT1 as the power supply voltage. The inverter 231 has an input terminal which receives a driving signal (signal corresponding to the discharge control signal) output from the level converter 105, and an output terminal connected to the driving element 10. The pull-up transistor 232 pulls up a voltage at the input terminal of the inverter 231 in accordance with the stop signal output from the monitoring circuit 202 to the stop signal line 106.

The monitoring circuit 202 monitors the first voltage VDD, and outputs a stop signal to the stop signal line 106 upon a drop of the first voltage VDD. The control circuit 220 of each ink driving circuit 201 is configured to stop driving the electrothermal transducer Rh by the driving element 10 in accordance with the stop signal. The monitoring circuit 202 includes a transistor (NMOS transistor) MN2 and step-down circuit 108. The transistor MN2 has a drain connected to a side of a power supply voltage node PSN which receives a third voltage VHT2 higher than the first voltage VDD, and a source connected to a side of ground. The transistor MN2 receives the first voltage VDD at the gate. The step-down circuit 108 is interposed between the power supply voltage node PSN and the drain of the transistor MN2, and decreases a voltage applied between the source and drain of the transistor MN2. The second voltage VHT1 and third voltage VHT2 may be equal to or different from each other.

The monitoring circuit 202 further includes a current mirror circuit 240 and fourth transistor MN5. The current mirror circuit 240 is formed from a second transistor MP6 interposed between the power supply voltage node PSN and the step-down circuit 108, and a third transistor MP7 interposed between the power supply voltage node PSN and an output node OUTN. The gates of the second transistor MP6 and third transistor MP7 are connected to the drain of the second transistor MP6. The fourth transistor MN5 has a drain connected to the output node OUTN, a source connected to a side of ground, and a gate connected to the drain of the transistor MN2. In the second embodiment, the stop signal is output from the output node OUTN to the stop signal line 106. The output node OUTN is a node at which the voltage changes depending on a voltage at the drain of the transistor MN2.

When supply of the first voltage VDD from the major portion is cut off and a voltage on the supply line becomes almost the ground level, the transistor MN2 is turned off, and no current flows through the transistor MP6. Then, voltages at the drain of the transistor MN2 and the drain (and gate) of the transistor MP6 rise to almost the third voltage VHT2. Since the drain of the transistor MN2 is connected to the gate of the transistor MN5, the NMOS transistor MN5 is turned on. In contrast, since the drain (and gate) of the transistor MP6 is connected to the gate of the transistor MP7, the transistor MP7 is turned off. The stop signal output from the output node OUTN to the stop signal line 106 becomes almost the logical low level (almost ground level).

While the second voltage VHT1 is applied without applying the first voltage VDD, voltages at the gates of the transistors MP3 and MP4 become indefinite, and a voltage at the output node OUT of the level converter 105 also becomes indefinite. However, the stop signal output from the output node OUTN of the monitoring circuit 202 is at the logical low level. Thus, the pull-up transistor 232 is turned on, and the input signal of the inverter 231 can be forcibly fixed at the logical high level.

Hence, the voltage at the gate of a transistor MN1 serving as the driving element 10 becomes almost the logical low level (almost ground level), maintaining the OFF state. As a result, a current flowing through the electrothermal transducer Rh can be cut off. While the first voltage VDD is applied appropriately, the pull-up transistor 232 is turned off and does not affect a general operation.

According to the second embodiment, the ink driving circuit 201 (or control circuit 220) can be configured by a smaller number of elements than those of the ink driving circuit 104 having the NOR circuit 23 in the first embodiment. Note that a NOR circuit having the CMOS arrangement is generally formed from four transistors, and an inverter circuit having the CMOS arrangement is generally formed from two transistors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-079803, filed Mar. 31, 2011, which is hereby incorporated by reference herein in its entirety.

What is claimed is:

1. A liquid discharge head which discharges a liquid, comprising:

a signal processing circuit which operates with a first voltage, and generates a discharge control signal for controlling discharge of a liquid;

a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit includes a circuit having a power receiving terminal which receives the second voltage, a first input terminal which receives a signal associated with the discharge control signal, a second input terminal which receives the stop signal, and an output terminal which outputs the driving signal when the stop signal is not activated, but does not output the driving signal when the stop signal is activated, wherein the monitoring circuit includes a transistor which includes a drain connected to a side of a power supply voltage node, a source connected to a side of ground, and a gate receiving the first voltage, and a step-down circuit which is interposed between the power supply voltage node and the drain and decreases a voltage applied between the source and the drain, and wherein the stop signal is output from the drain or a node at which a voltage changes depending on a voltage at the drain.

2. The head according to claim 1, wherein the step-down circuit includes a resistance element.

3. A liquid discharge apparatus comprising a liquid discharge head defined in claim 1.

4. The head according to claim 1, wherein the transistor has a lower impedance upon being applied with a voltage of a predetermined level or higher to the gate thereof than an impedance of the step-down circuit.

5. A liquid discharge head which discharges a liquid, comprising:

a signal processing circuit which operates with a first voltage, and generates a discharge control signal for controlling discharge of a liquid;

a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit is configured to stop driving the electrothermal transducer by the driving element in accordance with the stop signal, wherein the monitoring circuit includes a transistor which includes a drain connected to a side of a power supply voltage node, a source connected to a side of ground, and a gate receiving the first voltage, and a step-down circuit which is interposed between the power supply voltage node and the drain and decreases a voltage applied between the source and the drain, and wherein the stop signal is output from the drain, and wherein the control circuit includes a NOR circuit including a first input terminal for receiving a signal associated with the discharge control signal, a second input terminal for receiving the stop signal, and an output terminal connected to the driving element.

6. A liquid discharge head which discharges a liquid, comprising:

a signal processing circuit which operates with a first voltage, and generates a discharge control signal for controlling discharge of a liquid;

a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit is configured to stop driving the electrothermal transducer by the driving element in accordance with the stop signal, and wherein the monitoring circuit includes a transistor which includes a drain connected to a side of a power supply voltage node, a source connected to a side of ground, and a gate receiving the first voltage, a step-down circuit which is interposed between the power supply voltage node and the drain and decreases a voltage applied between the source and the drain, a current mirror circuit which is formed from a second transistor interposed between the power supply voltage node and the step-down circuit, and a third transistor interposed between the power supply voltage node and an output node, and a fourth transistor which includes a drain connected to the output node, a source connected to a side of ground, and a gate connected to the drain of the transistor, and the stop signal is output from the output node.

7. The head according to claim 6, wherein the control circuit includes an inverter including an input terminal which receives a signal associated with the discharge control signal and an output terminal connected to the driving element, and a pull-up transistor which pulls up a voltage at the input terminal in accordance with the stop signal.

8. A liquid discharge head which discharges a liquid, comprising:

a signal processing circuit which operates with a first voltage, and generates a discharge control signal for controlling discharge of a liquid;

a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit is configured to stop driving the electrothermal transducer by the driving element in accordance with the stop signal, wherein the monitoring circuit includes a transistor which includes a drain connected to a side of a power supply voltage node, a source connected to a side of ground, and a gate receiving the first voltage, and a step-down circuit which includes a diode interposed between the power supply voltage node and the drain and decreases a voltage applied between the source and the drain, and wherein the stop signal is output from the drain or a node at which a voltage changes depending on a voltage at the drain.

9. A liquid discharge head which discharges a liquid, comprising:

a signal processing circuit which operates with a first voltage, and generates a discharge control signal for controlling discharge of a liquid;

a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit is configured to stop driving the electrothermal transducer by the driving element in accordance with the stop signal, wherein the monitoring circuit includes a transistor which includes a drain connected to a side of a power supply voltage node, a source connected to a side of ground, and a gate receiving the first voltage, and a step-down circuit which includes a diode-connected MOS transistor interposed between the power supply voltage node and the drain and decreases a voltage applied between the source and the drain, and wherein the stop signal is output from the drain or a node at which a voltage changes depending on a voltage at the drain.

10. A liquid discharge head which discharges a liquid, comprising:

a signal processing circuit which operates with a first voltage, and generates a discharge control signal for controlling discharge of a liquid;

a liquid driving circuit including an electrothermal transducer, a driving element which drives the electrothermal transducer, and a control circuit which receives the discharge control signal from the signal processing circuit and outputs, to the driving element, a driving signal having a second voltage higher than the first voltage; and a monitoring circuit which monitors the first voltage and outputs a stop signal upon a drop of the first voltage, wherein the control circuit is configured to stop driving the electrothermal transducer by the driving element in accordance with the stop signal, wherein the monitoring circuit includes a transistor which includes a drain connected to a side of a power supply voltage node, a source connected to a side of ground, and a gate receiving the first voltage, and a step-down circuit which is interposed between the power supply voltage node and the drain and decreases a voltage applied between the source and the drain, and wherein the stop signal is output from the drain or a node at which a voltage changes depending on a voltage at the drain, and wherein the control circuit includes a level converter which operates with the second voltage and a circuit which operates with the second voltage, wherein the level converter outputs a signal which has the second voltage and which is associated with the discharge control signal, and the circuit outputs the driving signal corresponding to the signal output from the level converter when the stop signal is not activated and does not output the driving signal when the stop signal is activated.

* * * * *